US010379454B2

(12) United States Patent
Koyama

(10) Patent No.: US 10,379,454 B2
(45) Date of Patent: Aug. 13, 2019

(54) ELECTROSTATIC LATENT IMAGE DEVELOPING TONER

(71) Applicant: KYOCERA Document Solutions Inc., Osaka (JP)

(72) Inventor: Akinori Koyama, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/942,785

(22) Filed: Apr. 2, 2018

(65) Prior Publication Data

US 2018/0292765 A1 Oct. 11, 2018

(30) Foreign Application Priority Data

Apr. 7, 2017 (JP) ..... 2017-076579

(51) Int. Cl.

| | |
|---|---|
| ***G03G 9/087*** | (2006.01) |
| ***G03G 11/00*** | (2006.01) |
| ***G03G 9/08*** | (2006.01) |
| ***G03G 9/097*** | (2006.01) |

(52) U.S. Cl.

CPC ..... *G03G 11/00* (2013.01); *G03G 9/0821* (2013.01); *G03G 9/0825* (2013.01); *G03G 9/08755* (2013.01); *G03G 9/08782* (2013.01); *G03G 9/09733* (2013.01); *G03G 9/09758* (2013.01); *G03G 9/09775* (2013.01)

(58) Field of Classification Search

CPC ..... G03G 9/08782; G03G 9/09733; G03G 9/09775

See application file for complete search history.

(56) References Cited

U.S. PATENT DOCUMENTS

| | | | | |
|---|---|---|---|---|
| 2013/0101934 A1* | 4/2013 | Chiba | ..... | G03G 9/0819 430/108.7 |
| 2015/0248071 A1* | 9/2015 | Katsura | ..... | G03G 9/08755 430/109.3 |

FOREIGN PATENT DOCUMENTS

| | | | | |
|---|---|---|---|---|
| GB | 944396 | * 12/1963 | ..... | G03G 9/08 |
| JP | 61-260253 | * 11/1986 | ..... | G03G 9/09733 |
| JP | 02-251969 | * 10/1990 | ..... | G03G 9/08 |
| JP | 2016-004229 A | 1/2016 | | |

OTHER PUBLICATIONS

Translation of JP 02-251969.*
Translation of Abstract of JP 61-260253.*

* cited by examiner

*Primary Examiner* — Peter L Vajda
(74) *Attorney, Agent, or Firm* — Studebaker & Brackett PC

(57) ABSTRACT

An electrostatic latent image developing toner has positive chargeability and includes a plurality of toner particles. The toner particles each include primary domains made from a primary mixture. The primary mixture contains a wax and an antioxidant. The antioxidant is contained in an amount of at least 1.8 parts by mass and no greater than 15.8 parts by mass relative to 100 parts by mass of the primary mixture.

10 Claims, No Drawings

ELECTROSTATIC LATENT IMAGE DEVELOPING TONER

INCORPORATION BY REFERENCE

The present application claims priority under 35 U.S.C. § 119 to Japanese Patent Application No. 2017-076579, filed on Apr. 7, 2017. The amounts of this application are incorporated herein by reference in their entirety.

BACKGROUND

The present disclosure relates to an electrostatic latent image developing toner.

In image formation on a recording medium using toner, a toner image transferred to the recording medium is fixed to the recording medium by heating in some cases. In order to achieve high-speed printing and reduction in environmental burden, reduction in thermal energy used for fixing an image to a recording medium (also referred to below as "fixing energy") is recently demanded.

SUMMARY

An electrostatic latent image developing toner according to the present disclosure has positive chargeability and includes a plurality of toner particles. The toner particles each include primary domains made from a primary mixture. The primary mixture contains a wax and an antioxidant. The antioxidant is contained in an amount of at least 1.8 parts by mass and no greater than 15.8 parts by mass relative to 100 parts by mass of the primary mixture.

DETAILED DESCRIPTION

Hereinafter, an embodiment of the present disclosure will be described in detail. Note that unless otherwise stated, evaluation results (for example, values indicating shapes and physical properties) for a powder are number averages of values measured with respect to an appropriate number of average particles selected from the powder. The powder includes for example toner cores, toner mother particles, an external additive, and a toner. The toner mother particles refer to toner particles to which no external additive adheres.

Unless otherwise stated, the number average particle diameter of a powder is a number average value of equivalent circle diameters of primary particles (i.e., diameters of circles having the same areas as projections of the particles) measured using a microscope. Unless otherwise stated, a measurement value of the volume median diameter ($D_{50}$) of a powder is a value measured based on Coulter principle (electrical sensing zone method) using "Coulter Counter Multisizer 3" produced by Beckman Coulter, Inc.

Values for a glass transition point (Tg) and a melting point (Mp) each are a value measured using a differential scanning calorimeter ("DSC-6220", product of Seiko Instruments Inc.) unless otherwise stated. A value for a softening point (Tm) is a value measured using a capillary rheometer ("CFT-500D", product of Shimadzu Corporation) unless otherwise stated. A value for a thermal decomposition temperature is a value measured using a thermogravimetry/differential thermal analyzer (TG-DTA) unless otherwise stated. The thermal decomposition temperature refers to a temperature on a plotted TG-DTA curve at which mass reduction of a sample starts in accompaniment with thermal decomposition of the sample.

Unless otherwise stated, chargeability is equated with readiness for frictional charging. For example, a toner can be frictionally charged by mixing the toner with the Standard Carrier (anionic strength: N-01, cationic strength: P-01) provided from The Imaging Society of Japan. The surface potentials of toner particles before and after frictional charging are measured for example using a kelvin probe force microscopy (KFM), and it is determined that a portion of the toner particles having a larger potential difference between before and after frictional charging has high chargeability.

Note that in the present description the term "-based" may be appended to the name of a chemical compound in order to form a generic name encompassing both the chemical compound itself and derivatives thereof. Also, when the term "-based" is appended to the name of a chemical compound used in the name of a polymer, the term indicates that a repeating unit of the polymer originates from the chemical compound or a derivative thereof. In the present description, the term "(meth)acryl" is used as a generic term for both acryl and methacryl. Acrylonitrile and methacrylonitrile may be referred collectively to as "(meth)acrylonitrile".

An electrostatic latent image developing toner according to the present embodiment has positive chargeability. The positively chargeable toner can be used for image formation for example using an electrophotographic apparatus (image forming apparatus). The following method is employable for image formation using the positively chargeable toner. First, a charger uniformly charges a photosensitive layer of a photosensitive drum. Next, a light exposure device forms an electrostatic latent image on the photosensitive layer based on image data. Subsequently, a development device develops the electrostatic latent image using the positively chargeable toner.

Specifically, the development device includes a development roller disposed in the vicinity of the photosensitive drum. A development sleeve of the development roller attracts the positively chargeable toner by magnetic force of the development roller (specifically, a magnet roll included in the development roller). Through attraction as above, a toner layer is formed on a surface of the development roller. When the development sleeve is rotated, the positively chargeable toner included in the toner layer is supplied to the photosensitive layer of the photosensitive drum. Through the above, the electrostatic latent image is developed and the toner image is formed on the surface of the photosensitive layer.

Subsequently, a transfer device transfers the toner image to a recording medium. Thereafter, a fixing device fixes toner particles included in the toner image to the recording medium (a fixing process). An example of the fixing device is a heating roller.

As will be described later in Examples, the positively chargeable toner may constitute a one-component developer or a two-component developer in combination with a carrier. In a configuration in which the positively chargeable toner constitutes a one-component developer, the positively chargeable toner is positively charged by friction with a blade in the development device. In a configuration in which the positively chargeable toner constitutes a two-component developer, the positively chargeable toner is positively charged by friction with a carrier in the development device.

[Basic Features of Electrostatic Latent Image Developing Toner]

The electrostatic latent image developing toner according to the present embodiment has the following basic features. Specifically, the electrostatic latent image developing toner according to the present embodiment has positive chargeability and includes a plurality of toner particles. The toner particles each include primary domains made from a primary mixture. The primary mixture contains a wax and an antioxidant. The antioxidant is contained in an amount of at least 1.8 parts by mass and no greater than 15.8 parts by mass relative to 100 parts by mass of the primary mixture. Hereinafter, a "content of the antioxidant relative to 100 parts by mass of the primary mixture" is referred to simply as a "content of the antioxidant in the primary mixture". The content of the antioxidant in the primary mixture is measured by a method described in later-described Examples or a method in conformity therewith.

The positively chargeable toner according to the present embodiment is preferably produced by the following method. A production method of the positively chargeable toner according to the present embodiment involves a toner particle production process. The toner particle production process includes a primary mixture production process. The primary mixture contains a wax and an antioxidant. The toner particles each include primary domains made from the primary mixture. The toner particle production process is performed at a temperature of below the thermal decomposition temperature of the antioxidant.

As described above, the toner particle production process in the present embodiment is performed at a temperature of below the thermal decomposition temperature of the antioxidant without exposure to a temperature equal to or higher than the thermal decomposition temperature of the antioxidant. This can inhibit a low-melting point material from being melted and volatilized or from being thermally decomposed during production of the positively chargeable toner according to the present embodiment. Therefore, the positively chargeable toner according to the present embodiment can be produced using the low-melting point material. As a result, a positively chargeable toner that can achieve reduction in fixing energy can be provided in the present embodiment.

The toner particle production process is performed without exposure to a temperature equal to or higher than the thermal decomposition temperature of the antioxidant in the present embodiment. This can inhibit thermal decomposition of the antioxidant during production of the positively chargeable toner. Thus, the content of the antioxidant in the primary mixture of the produced positively chargeable toner tends to fall in a range of at least 1.8 parts by mass and no greater than 15.8 parts by mass.

An antioxidant is typically added to a product for the purpose of inhibiting oxidation and decomposition of components of the product. Specifically, oxidation and decomposition of the antioxidant itself inhibit oxidation and decomposition of components in the product other than the antioxidant. In image formation using the positively chargeable toner according to the present embodiment, the antioxidant accordingly is oxidized (thermal decomposition of the antioxidant) prior to oxidation of the low-melting point material contained in the positively chargeable toner. Prior oxidation of the antioxidant can inhibit volatilization and thermal decomposition of the low-melting point material during image formation. For example, even in a situation in which the positively chargeable toner is exposed to high temperature in image formation, the low-melting point material can be inhibited from volatilization and thermal decomposition. From the above, generation of ultrafine particles (UFP) can be prevented. Consequently, a positively chargeable toner that can prevent generation of UFP can be provided.

When the content of the antioxidant in the primary mixture is at least 1.8 parts by mass, thermal decomposition of the antioxidant can effectively inhibit volatilization and thermal decomposition of the low-melting point material during image formation. Therefore, generation of UFP can be effectively prevented. In view of the foregoing, the content of the antioxidant in the primary mixture is preferably at least 1.8 parts by mass.

When the content of the antioxidant in the primary mixture is no greater than 15.8 parts by mass, a situation in which an excessive amount of the antioxidant is contained in the positively chargeable toner can be prevented. When the content of the antioxidant in the primary mixture is no greater than 15.8 parts by mass, fixing offset resistance of the toner accordingly can be easily improved (see later-described Comparative Example 2). Fixing offset herein refers to a phenomenon of toner fusing to a surface of a fixing device (e.g., a heating roller). When fixing offset resistance of the toner is improved, images excellent in image quality can be formed. In view of the foregoing, the content of the antioxidant in the primary mixture is preferably no greater than 15.8 parts by mass.

As described above, the positively chargeable toner according to the present embodiment can achieve both reduction in fixing energy and prevention of generation of UFP.

In addition, the positively chargeable toner according to the present embodiment can achieve the following advantages. Specifically, the wax is an example of the low-melting point material contained in the positively chargeable toner. The primary mixture contains the wax and the antioxidant in the positively chargeable toner according to the present embodiment. In the above configuration, the wax tends to be present close to the antioxidant in the positively chargeable toner according to the present embodiment as compared to a toner in which an antioxidant is uniformly present in the entirety of each toner particle (also referred to below as a "toner of a reference example"). Accordingly, continuous occurrence of oxidation reaction or decomposition reaction of the wax at high temperature can be easily inhibited in the presence of the antioxidant in the positively chargeable toner according to the present embodiment as compared to in the toner of the reference example. When continuous occurrence of oxidation reaction or decomposition reaction of the wax at high temperature can be inhibited, generation of a material having a small molecular weight (e.g., a wax oxide) can be prevented, thereby preventing generation of a readily volatilized material. Consequently, generation of UFP can be prevented in image formation using the positively chargeable toner according to the present embodiment as compared to in image formation using the toner of the reference example.

As described above, continuous occurrence of oxidation reaction or decomposition reaction of the wax at high temperature can be easily prevented in the positively chargeable toner according to the present embodiment as compared to in the toner of the reference example. Therefore, even in a configuration in which the content of the antioxidant contained in the positively chargeable toner according to the present embodiment is less than that of the antioxidant contained in the toner of the reference example, continuous occurrence of oxidation reaction or decomposition reaction of the wax at high temperature can be prevented. Thus, the content of the antioxidant can be reduced in the positively chargeable toner according to the present embodiment as compared to in the toner of the reference example. Consequently, the positively chargeable toner according to the present embodiment is excellent in fixing offset resistance as compared to the toner of the reference example. More preferably, a portion of each toner particle other than the primary domains contains no antioxidant. In the above configuration, a positively chargeable toner further excellent in fixing offset resistance can be provided.

When the content of the antioxidant in the positively chargeable toner can be reduced, images excellent in image density can be formed even using a negatively chargeable antioxidant (see later-described Examples 2 and 4). Thus, types of materials usable for the antioxidant increases in the positively chargeable toner according to the present embodiment as compared to the toner of the reference example. When a positively chargeable antioxidant is used, charge amount of the positively chargeable toner tends to be kept in an appropriate range even after endurance in a later-described printing durability test and therefore images excellent in image density tend to be formed even after the endurance.

An example of antioxidants that have positive chargeability is an amine type antioxidant. The amine type antioxidant has an amino group in a molecule thereof. The amino group is known as a positively chargeable functional group. An example of antioxidants that have negative chargeability is a phenol type antioxidant. The phenol type antioxidant has a phenol group in a molecule thereof. The phenol group is known as a negatively chargeable functional group.

[Preferable Production Method of Positively Chargeable Toner]

The production method of the positively chargeable toner according to the present embodiment involves a toner particle production process. The toner particle production process preferably includes a toner mother particle production process and more preferably includes an external addition process in addition. It is only required that the toner mother particle production process includes a primary mixture production process and a toner core production process. The toner mother particle production process may not include a shell layer formation process. The shell layer formation process is usually performed at a temperature of no greater than 100° C. The external addition process is usually performed at room temperature. The room temperature is 25° C., for example. The thermal decomposition temperature of an ordinary antioxidant is higher than 120° C. From the above, performing the primary mixture production process and the toner core production process each at a temperature of below the thermal decomposition temperature of the antioxidant can mean performing the toner particle production process at a temperature of below the thermal decomposition temperature of the antioxidant.

In a case of no shell layer formation process being performed, toner cores produced by the following method and toner mother particles are equivalent. In a case of no external addition process being performed, toner mother particles produced by the following method and toner particles are equivalent. Toner particles produced at the same time are thought to have substantially the same configuration.

<Toner Mother Particle Production Process>

The primary mixture production process is performed first in the toner mother particle production process. The toner core production process is performed then. In a case of the shell layer formation process being performed, the shell layer formation process is preferably performed after the toner core production process.

(Primary Mixture Production Process)

The primary mixture is preferably produced by a dry method in the primary mixture production process. Specifically, the primary mixture is preferably produced by a method based on a pulverization method that is an example of the toner core production method. All processes except a material melt-kneading process are performed at room temperature in the pulverization method. Accordingly, melt-kneading a material of the primary mixture (also referred to below as a "wax-containing material") at a temperature of below the thermal decomposition temperature of an antioxidant can mean performing the primary mixture production process at a temperature of below the thermal decomposition temperature of the antioxidant. The wax-containing material contains a wax and the antioxidant as will be described below.

Specifically, the wax and the antioxidant are mixed together at room temperature first to yield the wax-containing material. An additional component may be further mixed in mixing the wax and the antioxidant together.

Next, the yielded wax-containing material is melt-kneaded at a temperature of below the thermal decomposition temperature of the antioxidant using a melt-kneader such as a single or twin screw extruder (first melt-kneading process). Thus, the primary mixture is produced.

The wax-containing material is melt-kneaded at a temperature of below the thermal decomposition temperature of the antioxidant in the present embodiment. This can inhibit thermal decomposition of the antioxidant. As described above, the thermal decomposition temperature of an antioxidant is higher than 120° C. In view of the above, the wax-containing material is preferably melt-kneaded at a temperature of no greater than 120° C.

More preferably, the temperature for melt-kneading of the wax-containing material (first melt-kneading temperature) is selected from a range of a melting point of the wax or higher and no greater than 120° C. When the first melt-kneading temperature is the melting point of the wax or higher, the wax tends to readily melt. When the first melt-kneading temperature is selected from the range of the melting point of the wax or higher and no greater than 120° C., the wax-containing material can accordingly be easily melt-kneaded while thermal decomposition of the antioxidant can be inhibited. More specifically, the first melt-kneading temperature is preferably selected from a range of at least 90° C. and no greater than 120° C.

The antioxidant is preferably in the form of a solid in mixing with the wax. That is, the antioxidant preferably has a melting point higher than room temperature. More preferably, an antioxidant having a melting point of at least 30° C. is used. Through use of such an antioxidant, a situation in which the wax-containing material is difficult to be melt-kneaded due to use of an antioxidant can be prevented. Thus, a situation in which it is difficult to produce the primary mixture due to use of the antioxidant can be prevented.

In mixing the wax and the antioxidant, preferably, 100 parts by mass of the wax and at least 2 parts by mass and no greater than 20 parts by mass of the antioxidant are mixed together. By doing so, the content of the antioxidant in the primary mixture tends to fall in a range of at least 1.8 parts by mass and no greater than 15.8 parts by mass in the resultant positively chargeable toner.

(Toner Core Production Process>

Toner cores are preferably produced by a pulverization method or an aggregation method in the toner core production process. By doing so, the toner cores can be easily produced.

(Toner Core Production Process: Pulverization Method)

In a situation in which the toner cores are produced by the pulverization method, all processes except a process (second melt-kneading process) of melt-kneading a toner core material (i.e., a toner material) are performed at room temperature. Accordingly, melt-kneading the toner core material at a temperature of below the thermal decomposition temperature of the antioxidant can mean performing the toner core production process at a temperature of below the thermal decomposition temperature of the antioxidant. The toner core material contains a binder resin and the primary mixture, as will be described later.

Specifically, the binder resin and the primary mixture are mixed together first at room temperature to yield the toner core material. An additional component may be mixed in mixing the binder resin and the primary mixture together. The additional component preferably includes at least one of a colorant and a charge control agent. The additional component may include a magnetic powder. The additional component preferably includes no antioxidant (does not contain any antioxidant different from the antioxidant contained in the primary mixture). When the additional component includes no antioxidant, a positively chargeable toner further excellent in fixing offset resistance can be provided.

Next, the yielded toner core material is melt-kneaded at a temperature of below the thermal decomposition temperature of the antioxidant using a melt-kneader (e.g., a single or twin screw extruder). Through melt-kneading at such a temperature, thermal decomposition of the antioxidant contained in the primary mixture can be inhibited. As described above, the thermal decomposition temperature of an antioxidant is higher than 120° C. Accordingly, it is preferable to melt-knead the toner core material at a temperature of no greater than 120° C. More preferably, the melt-kneading temperature of the toner core material (second melt-kneading temperature) is selected from a range of at least 90° C. and no greater than 120° C. When the second melt-kneading temperature is at least 90° C., the binder resin tends to be readily softened. Accordingly, when the second melt-kneading temperature is selected from the range of at least 90° C. and no greater than 120° C., the toner core material can be easily melt-kneaded while thermal decomposition of the antioxidant can be inhibited.

Subsequently, the resultant melt-kneaded substance is cooled to room temperature, and pulverized and classified at room temperature. Through the above, the toner cores (specifically, pulverized toner cores) are produced.

It is preferable in mixing the binder resin and the primary mixture that 100 parts by mass of the binder resin and at least 1 part by mass and no greater than 10 parts by mass of the primary mixture are mixed together. By doing so, an appropriate amount of the wax and an appropriate amount of the antioxidant can be contained in the resultant positively chargeable toner. Generation of UFP and occurrence of fixing offset can be further prevented in image formation using the positively chargeable toner as above.

(Toner Core Production Process: Aggregation Method)

In a situation in which the toner cores are produced by the aggregation method, all processes except a process of causing coalescence of components contained in aggregated particles (coalescence process) are performed at room temperature. Accordingly, when the components contained in the aggregated particles are caused to coalesce at a temperature of below the thermal decomposition temperature of the antioxidant, the toner cores can be produced without inviting thermal decomposition of the antioxidant.

Usually, the aggregated particles are heated to approximately 100° C. in the coalescence process. As described above, the thermal decomposition temperature of an antioxidant is higher than 120° C. As such, the toner cores can be produced at a temperature of below the thermal decomposition temperature of the antioxidant by a known aggregation method. Accordingly, the components contained in the aggregated particles can be caused to coalesce at a temperature of below the thermal decomposition temperature of the antioxidant even without changing heating temperature for the aggregated particles from that in the known aggregation method.

In the known aggregation method, an aqueous medium containing fine particles of the binder resin and the primary mixture is prepared first at room temperature. The aqueous medium may further contain colorant fine particles. The aqueous medium preferably contains no antioxidant (does not contain any antioxidant different from the antioxidant contained in the primary mixture). When the aqueous medium contains no antioxidant, a positively chargeable toner further excellent in fixing offset resistance can be provided. Thereafter, the fine particles of the binder resin and the colorant fine particles are aggregated in the aqueous medium. The resultant aggregated particles are heated to approximately 100° C. to cause coalescence of the components contained in the aggregated particles. Through the above, the toner cores (specifically, aggregated toner cores) are produced.

It is preferable that the primary mixture is contained in an amount of at least 1 part by mass and no greater than 10 parts by mass relative to 100 parts by mass of the binder resin in the aqueous medium. In the above configuration, an appropriate amount of the wax and an appropriate amount of the antioxidant can be contained in the resultant positively chargeable toner. Generation of UFP and occurrence of fixing offset can accordingly be further prevented in image formation using the positively chargeable toner as above.

(Shell Layer Formation Process)

Shell layers are formed on surfaces of the toner cores at a temperature of no greater than 100° C. for example by any one of in-situ polymerization, in-liquid curing film coating, and coacervation.

<External Addition Process>

The toner mother particles and an external additive are mixed together at room temperature using a mixer (e.g., an FM mixer, product of Nippon Coke & Engineering Co., Ltd.). Through the above mixing, external additive particles adhere to the surfaces of the toner mother particles. As a result, a positively chargeable toner including a plurality of toner particles each including the toner mother particle and the external additive is produced.

[Preferable Property of Materials Constituting Positively Chargeable Toner]

As described above in "Toner Core Production Process: Pulverization Method", the first melt-kneading temperature and the second melt-kneading temperature each are preferably no greater than 120° C. In view of the foregoing, a wax having a melting point of no greater than 120° C. is preferably used. The melting point of a wax contained in a positively chargeable toner is usually less than 100° C. Accordingly, any known material can be used for the wax contained in the positively chargeable toner in the present embodiment without specific limitation.

The binder resin preferably contains a resin having a low softening point (Tm). In a configuration for example in which the binder resin contains a resin having a softening point of no greater than 100° C. (also referred to below as an "LTm resin"), the positively chargeable toner according to the present embodiment can be produced even when the second melt-kneading temperature is no greater than 120° C. More preferably, the binder resin is constituted by the LTm resin.

However, the second melt-kneading temperature is high. Therefore, even the binder resin containing a resin having a softening point of greater than 100° C. (also referred to below as an "HTm resin") may be softened in the second melt-kneading process. As such, even the positively chargeable toner according to the present embodiment in which the binder resin contains the HTm resin may be produced through the second melt-kneading process at a second melt-kneading temperature of no greater than 120° C. The present inventor confirmed that even the positively chargeable toner according to the present embodiment in which the binder resin contained a resin having a softening point of approximately 150° C. could be produced through the second melt-kneading process at a second melt-kneading temperature of no greater than 120° C.

In a configuration in which the HTm resin is a thermoplastic resin, the binder resin containing the HTm resin tends to be readily softened in the second melt-kneading process. The positively chargeable toner according to the present embodiment can accordingly be produced in some cases through the second melt-kneading process at a second melt-kneading temperature of no greater than 120° C. Thus, types of resins usable for the binder resin increases in a configuration in which the binder resin contains a thermoplastic resin as compared to in a configuration in which the binder resin is constituted by a thermosetting resin.

As described above in "Toner Core Production Process: Aggregation Method", the toner cores can be produced without inviting thermal decomposition of the antioxidant even when heating temperature of the aggregated particles is not changed from that in the known aggregation method. Accordingly, any known material can be used as the binder resin contained in the aggregated toner cores without imposing any limitation in production of the positively chargeable toner according to the present embodiment by the aggregation method.

[Examples of Materials Constituting Positively Chargeable Toner]

In a configuration in which the toner particles each include a toner core and a shell layer, the toner cores preferably contain the binder resin and the primary mixture.

<Toner Cores>

(Binder Resin)

The binder resin constitutes a large proportion (for example, at least 85% by mass) of components of the toner cores. Therefore, properties of the binder resin are thought to have a large influence on overall properties of the toner cores.

Combinational use of a plurality of resins as the binder resin can result in adjustment of a property (specifically, hydroxyl value, acid value, glass transition point, or softening point) of the binder resin. For example, when the binder resin has an amino group or an amide group, the toner cores have strong tendency to be cationic.

The binder resin preferably contains a thermoplastic resin. Examples of thermoplastic resins that can be used include polyester resins, styrene-based resins, acrylic acid-based resins, olefin-based resins, vinyl resins, polyamide resins, and urethane resins. Examples of acrylic acid-based resins that can be used include acrylic acid ester polymers and methacrylic acid ester polymers. Examples of olefin-based resins that can be used include polyethylene resins and polypropylene resins. Examples of vinyl resins that can be used include vinyl chloride resins, polyvinyl alcohols, vinyl ether resins, and N-vinyl resins. Copolymers of the above listed resins, that is, copolymers of the above listed resins into which a repeating unit is introduced can be used each as a thermoplastic resin constituting the toner particles. For example, styrene-acrylic acid-based resins and styrene-butadiene-based resins can be used each as the thermoplastic resin constituting the binder resin. The following describes a polyester resin as an example of the binder resin in detail.

(Binder Resin: Polyester Resin)

A polyester resin is a copolymer of at least one alcohol and at least one carboxylic acid. Examples of alcohols that can be used for synthesis of the polyester resin include dihydric alcohols and tri- or higher-hydric alcohols listed below. Examples of dihydric alcohols that can be used include diols and bisphenols. For example, the following dibasic carboxylic acids and tri- or higher-basic carboxylic acids can be used each as a carboxylic acid for synthesis of the polyester resin.

Preferable examples of the diols include aliphatic diols. Preferable examples of the aliphatic diols include diethylene glycol, triethylene glycol, neopentyl glycol, 1,2-propanediol, α,ω-alkanediols, 2-butene-1,4-diol, 1,4-cyclohexanedimethanol, dipropylene glycol, polyethylene glycol, polypropylene glycol, and polytetramethylene glycol. A preferable α,ω-alkanediol is ethylene glycol, 1,3-propanediol, 1,4-butanediol, 1,5-pentanediol, 1,6-hexanediol, 1,7-heptanediol, 1,8-octanediol, 1,9-nonanediol, or 1,12-dodecanediol.

Preferable examples of the bisphenols include bisphenol A, hydrogenated bisphenol A, bisphenol A ethylene oxide adduct, and bisphenol A propylene oxide adduct.

Preferable examples of the tri- or higher-hydric alcohols include sorbitol, 1,2,3,6-hexanetetraol, 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, and 1,3,5-trihydroxymethylbenzene.

Preferable examples of the dibasic carboxylic acids include aromatic dicarboxylic acids, α,ω-alkane dicarboxylic acids, unsaturated dicarboxylic acids, and cycloalkane dicarboxylic acids. A preferable aromatic dicarboxylic acid is phthalic acid, terephthalic acid, or isophthalic acid. A preferable α,ω-alkane dicarboxylic acid is malonic acid, succinic acid, adipic acid, suberic acid, azelaic acid, sebacic acid, or 1,10-decanedicarboxylic acid. A preferable unsaturated dicarboxylic acid is maleic acid, fumaric acid, citraconic acid, itaconic acid, or glutaconic acid. A preferable cycloalkane dicarboxylic acid is cyclohexanedicarboxylic acid.

Preferable examples of the tri- or higher-basic carboxylic acids include 1,2,4-benzenetricarboxylic acid (trimellitic acid), 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, and EMPOL trimer acid.

(Primary Mixture: Wax)

The wax is for example used in order to improve fixability of the positively chargeable toner or resistance of the positively chargeable toner to being offset at high temperature. The toner cores are preferably produced using a cationic wax in order to increase the cationic strength of the toner cores.

Preferable examples of the wax include aliphatic hydrocarbon waxes, plant waxes, animal waxes, mineral waxes, waxes containing a fatty acid ester as a major component, and waxes in which a part or all of a fatty acid ester has been deoxidized. Preferable examples of the aliphatic hydrocarbon waxes include low molecular weight polyethylene, low molecular weight polypropylene, polyolefin copolymer, polyolefin wax, microcrystalline wax, paraffin wax, and Fischer-Tropsch wax. Examples of the aliphatic hydrocarbon waxes also include oxides of the above-listed aliphatic hydrocarbon waxes. Preferable examples of the plant waxes include candelilla wax, carnauba wax, Japan wax, jojoba wax, and rice wax. Preferable examples of the animal waxes include beeswax, lanolin, and spermaceti. Preferable examples of the mineral waxes include ozokerite, ceresin, and petrolatum. Preferable examples of the waxes containing a fatty acid ester as a major component include montanic acid ester wax and castor wax. One of the waxes listed above may be used alone, or plural waxes listed above may be used in combination.

(Primary Mixture: Antioxidant)

The antioxidant is preferably in the form of a solid at room temperature. For example, an aromatic compound having an amino group in a molecule thereof is preferable as the amine type antioxidant. Specifically, the amine type antioxidant is preferably a diphenylamine derivative, a phenothiazine derivative, or a quinoline derivative. One amine type antioxidant listed above may be used alone, or plural amine type antioxidants listed above may be used in combination. In a situation in which plural amine type antioxidants are used in combination, a total amount of the amine type antioxidants is preferably at least 2 parts by mass and no greater than 20 parts by mass relative to 100 parts by mass of the wax.

Preferable examples of the diphenylamine derivative include 4-isopropylaminodiphenylamine, N-(1,3-dimethylbutyl)-N'-phenyl-1,4-phenylenediamine, and di(octylphenyl)amine. In di(octylphenyl)amine, two aromatic rings are present in a molecule thereof and one of hydrogen atoms constituting each aromatic ring is substituted by a $—C_8H_{17}$ group. It is only required that the $—C_8H_{17}$ groups are each, independently of one another, located at any of para position, ortho position, and meta position relative to an amino group. An example of the di(octylphenyl)amine is di(4-octylphenyl)amine. A preferable example of the quinoline derivative is poly(2,2,4-trimethyl-1,2 dihydroquinoline).

More specifically, "ANTAGE (registered Japanese trademark) 3C", "ANTAGE 6C", or "ANTAGE LDA" each produced by Kawaguchi Chemical Industry Co., Ltd. can be used as the diphenylamine derivative. "ANTAGE STDP-N" produced by Kawaguchi Chemical Industry Co., Ltd. can be used as the phenothiazine derivative. "ANTAGE RD" produced by Kawaguchi Chemical Industry Co., Ltd. can be used as the quinoline derivative.

The phenol type antioxidant is preferably a cresol derivative or a hydroquinone derivative. One phenol type antioxidant may be used alone, or plural phenol type antioxidants may be used in combination. In a situation in which plural phenol type antioxidants are used in combination, a total amount of the phenol type antioxidants is preferably at least 2 parts by mass and no greater than 20 parts by mass relative to 100 parts by mass of the wax.

Preferable examples of the cresol derivative include 4,4'-butylidene bis(6-tert-butyl-m-cresol), 2,2'-methylene bis(6-tert-butyl-p-cresol), 2,2'-methylene bis(6-tert-butyl-4-ethylphenol), 4,4'-thiobis(6-tert-butyl-m-cresol), and 2,6-di-tert-butyl-p-cresol. Preferable examples of the hydroquinone derivative include 2,5-di-tert-amylhydroquinone and 2,5-di-tert-butylhydroquinone.

More specifically, "ANTAGE (registered Japanese trademark) W-300", "ANTAGE W-400", "ANTAGE W-500", "ANTAGE Crystal", or "ANTAGE BHT" each produced by Kawaguchi Chemical Industry Co., Ltd. can be used as the cresol derivative. "ANTAGE DAH" or "ANTAGE DBH" each produced by Kawaguchi Chemical Industry Co., Ltd. can be used as the hydroquinone derivative.

An amine type antioxidant and a phenol type antioxidant may be used in combination. In a situation in which an amine type antioxidant and a phenol type antioxidant are used in combination, a total amount of the amine type antioxidant and the phenol type antioxidant is preferably at least 2 parts by mass and no greater than 20 parts by mass relative to 100 parts by mass of the wax.

(Combination of Materials)

In order to provide an electrostatic latent image developing toner that can achieve both reduction in fixing energy and prevention of generation of UFP, it is preferable that the primary mixture contains an ester wax as the wax and at least one of an amine type antioxidant and a phenol type antioxidant as the antioxidant. More preferably, the primary mixture contains an ester wax as the wax and a diphenylamine derivative, which is an amine type antioxidant, as the antioxidant. It is further preferable that the primary mixture contains an ester wax as the wax and at least one of a cresol derivative and a hydroquinone derivative, each of which is a phenol type antioxidant, as the antioxidant.

(Charge Control Agent)

The charge control agent is for example used in order to improve charge stability or a charge rise characteristic of the positively chargeable toner. The charge rise characteristic of the positively chargeable toner is an indicator as to whether the positively chargeable toner can be charged to a specific charge level in a short period of time. The cationic strength of the toner cores can be increased through the toner cores containing a positively chargeable charge control agent.

(Colorant)

The colorant can be a known pigment or dye that matches the color of the positively chargeable toner. The amount of the colorant is preferably at least 1 part by mass and no greater than 20 parts by mass relative to 100 parts by mass of the binder resin in order that high-quality images are formed using the positively chargeable toner.

The toner cores may contain a black colorant. Carbon black can for example be used as a black colorant. Alternatively, a colorant can be used that has been adjusted to a black color using colorants such as a yellow colorant, a magenta colorant, and a cyan colorant.

The toner cores may contain a non-black colorant such as a yellow colorant, a magenta colorant, or a cyan colorant.

Examples of yellow colorants that can be used include at least one compound selected from the group consisting of condensed azo compounds, isoindolinone compounds, anthraquinone compounds, azo metal complexes, methine compounds, and arylamide compounds. Specific examples of yellow colorants that can be used include C.I. Pigment Yellow (3, 12, 13, 14, 15, 17, 62, 74, 83, 93, 94, 95, 97, 109, 110, 111, 120, 127, 128, 129, 147, 151, 154, 155, 168, 174, 175, 176, 180, 181, 191, or 194), Naphthol Yellow S, Hansa Yellow G, and C.I. Vat Yellow.

Examples of magenta colorants that can be used include at least one compound selected from the group consisting of condensed azo compounds, diketopyrrolopyrrole compounds, anthraquinone compounds, quinacridone compounds, basic dye lake compounds, naphthol compounds, benzimidazolone compounds, thioindigo compounds, and perylene compounds. Specific examples of magenta colorants that can be used include C.I. Pigment Red (2, 3, 5, 6, 7, 19, 23, 48:2, 48:3, 48:4, 57:1, 81:1, 122, 144, 146, 150, 166, 169, 177, 184, 185, 202, 206, 220, 221, or 254).

Examples of cyan colorants that can be used include at least one compound selected from the group consisting of copper phthalocyanine compounds, anthraquinone compounds, and basic dye lake compounds. Specific examples of cyan colorants that can be used include C.I. Pigment Blue (1, 7, 15, 15:1, 15:2, 15:3, 15:4, 60, 62, or 66), Phthalocyanine Blue, C.I. Vat Blue, and C.I. Acid Blue.

(Magnetic Powder)

The positively chargeable toner may contain a magnetic powder in a configuration constituting a one-component developer. Examples of materials of a magnetic powder that can be used include ferromagnetic metals or alloys thereof, ferromagnetic metal oxides, and materials subjected to ferromagnetization. Examples of ferromagnetic metals that can be used include iron, cobalt, and nickel. Examples of ferromagnetic metal oxides that can be used include ferrite, magnetite, and chromium dioxide. Examples of ferromagnetization include thermal treatment. One magnetic powder listed above may be used alone, or two or more magnetic powders listed above may be used in combination.

The magnetic powder is preferably subjected to surface treatment in order to inhibit elution of metal ions (for example, iron ions) from the magnetic powder. When metal ions are eluted to surfaces of the toner cores in a situation in which shell layers are formed on the surfaces of the toner cores under an acidic condition, the toner cores tend to adhere to one another. It is thought that inhibition of the toner cores from adhering to one another can be achieved by inhibiting elution of metal ions from the magnetic powder.

<Shell Layers>

The shell layers preferably contain a thermoplastic resin. Examples of thermoplastic resins that can be contained in the shell layers include the thermoplastic resins listed in "Binder Resin" described above.

EXAMPLES

The following describes examples of the present disclosure. Table 1 shows toners T-1 to T-11 (each is an electrostatic latent image developing toner) of examples and comparative examples. A column titled "Blending ratio" of a column titled "Primary mixture" in Table 1 indicates blending ratios of respective primary mixtures relative to 100 parts by mass of a binder resin. "Melt-kneading temperature" in Table 1 corresponds to the second melt-kneading temperature. Primary mixtures A-1 to A-8 in a column titled "Type" of a column titled "Primary mixture" are as listed in Table 2.

TABLE 1

| | Primary mixture | | Melt-kneading |
|---|---|---|---|
| Toner | Type | Blending ratio (Part by mass) | temperature (° C.) |
| T-1 | A-1 | 5 | 100 |
| T-2 | A-2 | 5 | 100 |
| T-3 | A-3 | 5 | 100 |
| T-4 | A-4 | 5 | 100 |
| T-5 | A-5 | 5 | 100 |
| T-6 | A-6 | 5 | 100 |

TABLE 1-continued

| | Primary mixture | | Melt-kneading |
|---|---|---|---|
| Toner | Type | Blending ratio (Part by mass) | temperature (° C.) |
| T-7 | A-1 | 5 | 120 |
| T-8 | — | 0 | 100 |
| T-9 | A-7 | 5 | 100 |
| T-10 | A-8 | 5 | 100 |
| T-11 | A-1 | 5 | 130 |

TABLE 2

| Primary mixture | | | | | |
|---|---|---|---|---|---|
| Antioxidant | | | | | |
| Type | Material | Thermal decomposition temperature | Melting point | Blending ratio (Part by mass) | Content (Part by mass) |
| A-1 | LDA | >120° C. | ≥75° C. | 2.0 | 1.9 |
| A-2 | BHT | >120° C. | ≥69° C. | 2.0 | 1.8 |
| A-3 | LDA | >120° C. | ≥75° C. | 20.0 | 15.8 |
| A-4 | DBH | >120° C. | ≥202° C. | 2.0 | 1.9 |
| A-5 | LDA | >120° C. | ≥75° C. | 6.0 | 5.2 |
| A-6 | LDA | >120° C. | ≥75° C. | 12.0 | 10.1 |
| A-7 | LDA | >120° C. | ≥75° C. | 22.0 | 16.9 |
| A-8 | LDA | >120° C. | ≥75° C. | 1.5 | 1.4 |

"LDA" in Table 2 refers to an amine type antioxidant ("ANTAGE LDA", product of Kawaguchi Chemical Industry Co., Ltd., main component: di(octylphenyl)amine). "BHT" refers to a phenol type antioxidant ("ANTAGE BHT", product of Kawaguchi Chemical Industry Co., Ltd., main component: 2,6-di-tert-butyl-p-cresol). "DBH" refers to a phenol type antioxidant ("ANTAGE DBH", product of Kawaguchi Chemical Industry Co., Ltd., main component: 2,5-di-tert-butylhydroquinone). A column titled "Blending ratio" indicates blending ratios of respective antioxidants relative to 100 parts by mass of a wax. A column titled "Content" indicates a content of each antioxidant in a corresponding one of the primary mixtures. Specifically, the column titled "Content" indicates a content of each antioxidant determined by a method later described in [Property Value Determining Method for Primary Mixtures].

The following describes production methods of the primary mixtures A-1 to A-8. Production methods, evaluation methods, and evaluation results for the toners T-1 to T-11 according to the examples and the comparative examples (each is an electrostatic latent image developing toner) will be described next in the stated order. In evaluation in which errors may occur, an evaluation value was calculated by calculating the arithmetic mean of an appropriate number of measured values in order to ensure that any errors were sufficiently small. Number average particle diameters were measured using a transmission electron microscope (TEM). Unless otherwise stated, respective measuring methods of glass transition point (Tg) and softening point (Tm) are as described below.

<Tg Measuring Method>

A heat absorption curve of a sample (e.g., a resin) was plotted using a differential scanning calorimeter ("DSC-6220", product of Seiko Instruments Inc.). Subsequently, a glass transition point (Tg) of the sample was read from the plotted heat absorption curve. The glass transition point (Tg) of the sample corresponds to a temperature at a point of change in specific heat on the plotted heat absorption curve (i.e., an intersection point of an extrapolation of a base line and an extrapolation of an inclined portion of the curve).

<Tm Measuring Method>

A sample (e.g., a resin) was loaded in a capillary rheometer ("CFT-500D", product of Shimadzu Corporation) and an S-shaped curve (horizontal axis: temperature, vertical axis: stroke) of the sample was plotted by causing melt flow of 1 $cm^3$ of the sample under conditions of a die pore diameter of 1 mm, a plunger load of 20 $kg/cm^2$, and a heating rate of 6° C./minute. Subsequently, a softening point (Tm) of the sample was read from the plotted S-shaped curve. The softening point (Tm) of the sample corresponds to a temperature on the S-shaped curve corresponding to a stroke value of "$(S_1+S_2)/2$", where $S_1$ represents a maximum stroke value and $S_2$ represents a base line stroke value at low temperatures.

[Primary Mixture Production Methods]

(Production Method of Primary Mixture A-1)

Using an FM mixer (product of Nippon Coke & Engineering Co., Ltd.), 100.0 parts by mass of an ester wax (NISSAN ELECTOL (registered Japanese trademark) WEP-2", product of NOF Corporation) and 2.0 parts by mass of an amine type antioxidant ("ANTAGE LDA", product of Kawaguchi Chemical Industry Co., Ltd.) were mixed together at a rotational speed of 2,000 rpm.

The resultant wax-containing material was melt-kneaded using a twin screw extruder ("TEM-265S", product of Toshiba Machine Co. Ltd.) under conditions of a material feeding speed of 2 kg/hour, a shaft rotational speed of 130 rpm, and a setting temperature (cylinder temperature, corresponding to the first melt-kneading temperature) of 100° C. Subsequently, the resultant melt-kneaded substance was cooled and the cooled melt-kneaded substance was coarsely pulverized using a pulverizer ("ROTOPLEX (registered Japanese trademark) Type 16/8", product of Hosokawa Micron Corporation). Through the above, the primary mixture A-1 was produced.

(Production Method of Primary Mixture A-2)

A phenol type antioxidant ("ANTAGE BHT", product of Kawaguchi Chemical Industry Co., Ltd.) was used as an antioxidant instead of the amine type antioxidant ("ANTAGE LDA", product of Kawaguchi Chemical Industry Co., Ltd.). The primary mixture A-2 was produced according to the production method of the primary mixture A-1 except the above.

(Production Method of Primary Mixture A-3)

The blending ratio of the amine type antioxidant was changed to 20.0 parts by mass. The primary mixture A-3 was produced according to the production method of the primary mixture A-1 except the above.

(Production Method of Primary Mixture A-4)

A phenol type antioxidant ("ANTAGE DBH", product of Kawaguchi Chemical Industry Co., Ltd.) was used as an antioxidant instead of the amine type antioxidant ("ANTAGE LDA", product of Kawaguchi Chemical Industry Co., Ltd.). The primary mixture A-4 was produced according to the production method of the primary mixture A-1 except the above.

(Production Method of Primary Mixture A-5)

The blending ratio of the amine type antioxidant was changed to 6.0 parts by mass. The primary mixture A-5 was produced according to the production method of the primary mixture A-1 except the above.

(Production Method of Primary Mixture A-6)

The blending ratio of the amine type antioxidant was changed to 12.0 parts by mass. The primary mixture A-6 was produced according to the production method of the primary mixture A-1 except the above.

(Production Method of Primary Mixture A-7)

The blending ratio of the amine type antioxidant was changed to 22.0 parts by mass. The primary mixture A-7 was produced according to the production method of the primary mixture A-1 except the above.

(Production Method of Primary Mixture A-8)

The blending ratio of the amine type antioxidant was changed to 1.5 parts by mass. The primary mixture A-8 was produced according to the production method of the primary mixture A-1 except the above.

[Property Value Determining Method for Primary Mixtures]

A content of each antioxidant in a corresponding one of the primary mixtures (specifically, a corresponding one of the primary mixtures A-1 to A-8) was determined by the following method.

Specifically, the content of the antioxidant in each primary mixture was determined by an absolute calibration curve method using a gas chromatograph mass spectrometer ("GCMS-QP2010 Ultra", product of Shimadzu Corporation) under the following conditions. The determination results are shown in Table 2.

<Determination Conditions>

Column: metal capillary column ("ULTRA ALLOY (registered Japanese trademark)—5 (MS/HT)", product of Frontier Laboratories Ltd.).

Thermal decomposition temperature: 600° C. in a heating furnace, 400° C. in an interface portion.

Temperature increase conditions: temperature increase from 40° C. to 320° C. at a rate of 14° C./minute (thereafter, keeping at 320° C. for 15 minutes).

Carrier gas: helium (He) gas.

Column head pressure: 53.5 kPa.

Injection mode: split injection (split ratio 1:200).

Flow rate of carrier gas: total flow rate of 204 mL/minute, column flow rate of 1 mL/minute, purge flow rate of 3 mL/minute.

[Toner Production Methods]

<Production Method of Toner T-1>

First, a polyester resin (binder resin) was prepared. Toner mother particles were prepared using the prepared polyester resin. The prepared toner mother particles were subjected to external addition. Through the above, the toner T-1 was produced.

(Polyester Resin Preparation Process)

A four-necked flask (capacity: 2 L) equipped with a thermometer, a stainless steel stirrer, a glass nitrogen inlet tube, and a falling film condenser was charged with 55% by mol of ethylene glycol, 40% by mol of terephthalic acid, and 5% by mol of 1,2,4-benzenetricarboxylic acid anhydride. The flask was set in a heating mantle. A nitrogen gas was introduced into the flask through the glass nitrogen gas inlet pipe, and the internal temperature of the flask was increased to 200° C. The flask contents were stirred for polymerization reaction of the flask contents in a state in which a nitrogen atmosphere in the flask was maintained and the internal temperature of the flask was kept at 200° C. In a situation in which the amount of a monomer (e.g., ethylene glycol, terephthalic acid, or 1,2,4-benzenetricarboxylic acid anhydride) in the flask decreases due to scattering and sublimation of the flask contents, the monomer in an amount corresponding to the diminution was added to the flask. The flask contents were regularly sampled and an acid value of the sampled flask contents was measured. When the acid value of the flask contents reached 8 mgKOH/g, the flask contents were taken out onto a tray (polymerization reaction stop). The resultant reaction product taken out onto the tray was cooled to room temperature to yield a polyester resin. The glass transition point (Tg) and the softening point (Tm) of the yielded polyester resin were measured and found to be 57° C. and 125° C., respectively.

(Toner Mother Particle Production Process)

Using an FM mixer (product of Nippon Coke & Engineering Co., Ltd.), 100 parts by mass of the polyester resin, 5 parts by mass of the primary mixture A-1, 80 parts by mass of a magnetic powder ("TN-15", product of Mitsui Mining & Smelting Co., Ltd., component: magnetite), 3 parts by mass of a charge control agent ("ACRYBASE (registered Japanese trademark) FCA-207P", product of FUJIKURA KASEI CO., LTD., component: styrene-acrylic acid-based resin including a repeating unit derived from quaternary ammonium salt), and 2 parts by mass of a charge control agent (nigrosine dye: "BONTRON (registered Japanese trademark) N-71", product of ORIENT CHEMICAL INDUSTRIES, Co., Ltd.) were mixed together at a rotational speed of 2,400 rpm.

Subsequently, the resultant toner material was melt-kneaded using a twin screw extruder ("TEM-265S", product of Toshiba Machine Co. Ltd.) under conditions of a material feeding speed of 5 kg/hour, a shaft rotational speed of 160 rpm, and a setting temperature (cylinder temperature, corresponding to the second melt-kneading temperature) of 100° C. The resultant melt-kneaded substance was then cooled and the cooled melt-kneaded substance was coarsely pulverized using a pulverizer ("ROTOPLEX (registered Japanese trademark) Type 16/8", product of Hosokawa Micron Corporation). The coarsely pulverized substance was finely pulverized using a jet mill ("Super Sonic Jet Mill Model-I", product of Nippon Pneumatic Mfg.). The resultant finely pulverized substance was classified using a classifier ("Elbow Jet Type EJ-LABO", product of Nittetsu Mining Co., Ltd.). Through the above, toner mother particles having a volume median diameter ($D_{50}$) of 7 μm were produced.

(External Addition Process)

Using an FM mixer (product of Nippon Coke & Engineering Co., Ltd.), 100.0 parts by mass of the toner mother particles, 0.8 parts by mass of a positively chargeable silica particles ("AEROSIL (registered Japanese trademark) RA200", product of Nippon Aerosil Co., Ltd.), and 0.8 parts by mass of a conductive titanium oxide particles ("EC-100", product of Titan Kogyo, Ltd.) were mixed together. Through the above, the toner T-1 including multiple toner particles was produced.

[Production Methods of Toners T-2 to T-6]

The toners T-2 to T-6 were produced according to the production method of the toner T-1 in all aspects other than that the primary mixtures A-2 to A-6 were respectively used instead of the primary mixture A-1.

[Production Method of Toner T-7]

The toner T-7 was produced according to the production method of the toner T-1 in all aspects other than that the second melt-kneading temperature (melt-kneading temperature in Table 1) was changed from 100° C. to 120° C.

[Production Method of Toner T-8]

The toner T-8 was produced according to the production method of the toner T-1 in all aspects other than that an ester wax ("NISSAN ELECTOL WEP-2", product of NOF Corporation) was used instead of the primary mixture A-1.

[Production Methods of Toners T-9 and T-10]

The toners T-9 and T-10 were produced according to the production method of the toner T-1 in all aspects other than that the primary mixtures A-7 and A-8 were respectively used instead of the primary mixture A-1.

[Production Method of Toner T-11]

The toner T-11 was produced according to the production method of the toner T-1 in all aspects other than that the second melt-kneading temperature (melt-kneading temperature in Table 1) was changed from 100° C. to 130° C.

[Toner Evaluation Methods]

The number of generated UFP, fixing offset resistance of the toners, and image density were evaluated according to the following methods. Evaluation results are shown in Table 3.

<Method for Evaluating Number of Generated UFP>

An evaluation apparatus was prepared first. Specifically, a toner (specifically, any one of the toners T-1 to T-11) was loaded in a toner container of a multifunction peripheral ("TASKalfa 3510i", product of KYOCERA Document Solutions Inc.). Installation operation was performed on the multifunction peripheral to load the toner within the toner container into a development device of the multifunction peripheral. Through the above, the evaluation apparatus was prepared.

Next, the evaluation apparatus was installed in a stainless steel chamber (environmental test chamber, capacity: approximately 5 $m^3$) and the stainless steel chamber was ventilated over two hours. Thereafter, a printing durability test was performed over ten minutes. In the printing durability test, continuous printing of an image having a printing rate of 4% was performed on paper (A4-size paper). The number of UFP generated in the printing durability test (number of generated UFP) was counted using a particle size analyzer ("Fast Mobility Particle Sizer Spectrometer FMPS 3091", product of TSI Incorporated) under the measurement conditions defined in Basic Award Criteria RAL-UZ171 of an environmental label system "The Blue Angel" provided by the German Federal Ministry for the Environment, Nature Conservation, Building and Nuclear Safety.

When the number of generated UFP was no greater than $1.5\times10^{11}$, it was evaluated that generation of UFP was effectively prevented (excellent). When the number of generated UFP was greater than $1.5\times10^{11}$ and no greater than $3.0\times10^{11}$, it was evaluated that generation of UFP was prevented (good). When the number of generated UFP was greater than $3.0\times10^{11}$, it was evaluated that generation of UFP was not prevented (poor).

<Method for Evaluating Fixing Offset Resistance of Toners>

A printing durability test was performed in an environment at a temperature of 23° C. and a relative humidity of 50% using the evaluation apparatus used in <Method for Evaluating Number of Generated UFP> described above. In the printing durability test, continuous printing of an image having a printing rate of 4% was performed on 5,000 sheets of paper (A4-size paper). After the printing durability test, a sample solid image (length: 2.5 cm, width: 2.5 cm) was output on A4-size paper. The output paper (paper with the sample solid image printed thereon) was observed to confirm whether or not blotches on prints were present at regular intervals almost equal to the length of a fixing roller in a circumferential direction. When such blotches on prints were not observed, the toner was evaluated as being excellent in fixing offset resistance (good). When such blotches on prints were observed, the toner was evaluated as being poor in fixing offset resistance (poor).

<Method for Evaluating Image Density>

A sample solid image (length: 2.5 cm, width: 2.5 cm) was output on A4-size paper using the evaluation apparatus used in <Method for Evaluating Number of Generated UFP> in an environment at a temperature of 23° C. and a relative humidity of 50%. Thereafter, the reflection density (ID: image density) of the sample solid image was measured using a white photometer ("TC-6DS/A", product of Tokyo Denshoku Co., Ltd.). Through the above, initial image density was measured.

A printing durability test was performed next. In the printing durability test, an image having a printing rate of 4% was continuously printed on 5,000 sheets of paper (A4-size paper). After the printing durability test, a sample solid image (length: 2.5 cm, width: 2.5 cm) was output on A4-size paper. Thereafter, the reflection density (ID: image density) of the sample solid image was measured using a white photometer ("TC-6DS/A", product of Tokyo Denshoku Co., Ltd.). Through the above, post-endurance image density was measured.

When the initial image density was at least 1.0, it was evaluated that an image excellent in image density was formed at an initial stage. By contrast, when the initial image density was less than 1.0, it was evaluated that an image excellent in image density was not formed even at the initial stage. When the post-endurance image density was at least 1.0, it was evaluated that an image excellent in image density was formed even after the endurance. By contrast, when the post-endurance image density was less than 1.0, it was evaluated that an image excellent in image density was not formed after the endurance.

[Evaluation Results]

Table 3 shows evaluation results for the toners T-1 to T-11. A column titled "Offset resistance" in Table 3 indicates evaluation results of fixing offset resistance for the toners.

TABLE 3

| | | Number of | | Image density | |
|---|---|---|---|---|---|
| | Toner | Generated UFP (Count) | Offset resistance | Initial | After endurance |
| Example 1 | T-1 | $1.1 \times 10^{11}$ | Good | 1.2 | 1.1 |
| Example 2 | T-2 | $1.4 \times 10^{11}$ | Good | 1.2 | 1.1 |
| Example 3 | T-3 | $0.5 \times 10^{11}$ | Good | 1.3 | 1.3 |
| Example 4 | T-4 | $1.2 \times 10^{11}$ | Good | 1.2 | 1.1 |
| Example 5 | T-5 | $0.9 \times 10^{11}$ | Good | 1.2 | 1.2 |
| Example 6 | T-6 | $0.6 \times 10^{11}$ | Good | 1.3 | 1.2 |
| Example 7 | T-7 | $2.3 \times 10^{11}$ | Good | 1.2 | 1.2 |
| Comparative Example 1 | T-8 | $52.0 \times 10^{11}$ | Good | 0.8 | 0.7 |
| Comparative Example 2 | T-9 | $0.5 \times 10^{11}$ | Poor | 1.3 | 1.3 |
| Comparative Example 3 | T-10 | $23.1 \times 10^{11}$ | Good | 0.9 | 0.7 |
| Comparative Example 4 | T-11 | $8.7 \times 10^{11}$ | Good | 1.0 | 0.8 |

The toners T-1 to T-7 (toners of Examples 1 to 7) each had the aforementioned basic features. Specifically, each of the toners T-1 to T-7 had positive chargeability and included a plurality of toner particles. The toner particles each included primary domains made from a primary mixture. The primary mixture contained a wax and an antioxidant. The content of the antioxidant in the primary mixture was at least 1.8 parts by mass and no greater than 15.8 parts by mass relative to 100 parts by mass of the primary mixture.

The toners T-1 to T-7 were each produced according to the following method. Specifically, the production method of each of the toners T-1 to T-7 involved a toner particle production process. The toner particle production process included a primary mixture production process. The produced primary mixture contained a wax and an antioxidant. The toner particles each included primary domains made from the primary mixture. The toner particle production process was performed at a temperature of below the thermal decomposition temperature of the antioxidant.

With respect to each of the toners T-1 to T-7, as shown in Table 3, generation of UFP could be prevented in image formation using the toner. Further, images excellent in image quality could be formed without causing fixing offset. Images excellent in image density could be formed both at the initial stage and after the endurance.

By contrast, none of the toners T-8 to T-11 had the aforementioned basic features. Specifically, no primary mixture was used in production of the toner T-8 (toner of Comparative Example 1). It is thought that the toner T-8, which was produced using no primary mixture, was more difficult to have positive chargeability than the toners T-1 to T-7 (except the toners T-2 and T-4). The number of generated UFP was significantly greater in image formation using the toner T-8 than in image formation using the respective toners T-1 to T-7. Also, the image density was low both at the initial stage and after the endurance.

The toner T-9 (toner of Comparative Example 2) included primary domains made from the primary mixture A-7. The primary mixture A-7 was produced by mixing 100 parts by mass of an ester wax and 22.0 parts by mass of an amine type antioxidant. The content of the amine type antioxidant in the primary mixture of the toner T-9 was larger than those of the antioxidants in the primary mixtures of the respective toners T-1 to T-7. It is thought that the toner T-9, of which the primary mixture contained an amine type antioxidant more than the toners T-1 to T-7, could be highly charged in the installation operation. Fixing offset occurred in image formation using the toner T-9.

The toner T-10 (toner of Comparative Example 3) included primary domains made from the primary mixture A-8. The primary mixture A-8 was produced by mixing 100 parts by mass of an ester wax and 1.5 parts by mass of an amine type antioxidant. The content of the amine type antioxidant in the primary mixture of the toner T-10 was less than those of the antioxidants in the primary mixtures of the respective toners T-1 to T-7 (except the toners T-2 and T-4). It is thought that the toner T-10 was difficult to have positive chargeability because the content of the amine type antioxidant in the primary mixture was less than those of the antioxidants in the primary mixtures of the respective toners T-1 to T-7 (except the toners T-2 and T-4). The number of generated UFP was greater in image formation using the toner T-10 than in image formation using the respective toners T-1 to T-7. Also, the image density was low both at the initial stage and after the endurance.

The second melt-kneading temperature was 130° C. in production of the toner T-11 (toner of Comparative Example 4). It is therefore thought that the amine type antioxidant contained in the primary mixture was thermally decomposed readily in the melt-kneading of the toner material. The number of generated UFP was greater in image formation using the toner T-11 than in image formation using the respective toners T-1 to T-7. The image density was low after the endurance.

Note that the present inventor additionally produced a toner of a reference example according to the production method of the toner T-1 in all aspects other than that 5 parts by mass of an ester wax ("NISSAN ELECTOL WEP-2", product of NOF Corporation) and 5 parts by mass of an amine type antioxidant ("ANTAGE LDA", product of Kawaguchi Chemical Industry Co., Ltd.) were used instead of 5 parts by mass of the primary mixture A-1. The toner of the reference example was loaded into the toner container of the evaluation apparatus. The number of generated UFP was evaluated according to the method described above in <Method for Evaluating Number of Generated UFP>. As a result, the number of generated UFP was greater than $1.5\times10^{11}$ and no greater than $3.0\times10^{11}$. That is, the number of generated UFP was further smaller in image formation using any of the toners T-1 to T-7 than in image formation using the toner of the reference example.

What is claimed is:

1. An electrostatic latent image developing toner having positive chargeability, comprising a plurality of toner particles, wherein the toner particles each include primary domains made from a primary mixture, the primary mixture contains a wax and an antioxidant, the antioxidant is contained in an amount of at least 5.2 parts by mass and no greater than 15.8 parts by mass relative to 100 parts by mass of the primary mixture, the toner particles contain a binder resin, and an amount of the primary mixture is at least 1 part by mass and no greater than 5 parts by mass relative to 100 parts by mass of the binder resin.

2. The electrostatic latent image developing toner according to claim 1, wherein the electrostatic latent image developing toner is a pulverized toner, and the antioxidant has a melting point of at least 30° C.

3. The electrostatic latent image developing toner according to claim 2, wherein the antioxidant includes an amine type antioxidant, and the amine type antioxidant is at least one of a diphenylamine derivative, a phenothiazine derivative, and a quinoline derivative.

4. The electrostatic latent image developing toner according to claim 2, wherein the antioxidant includes a phenol type antioxidant, and the phenol type antioxidant is at least one of a cresol derivative and a hydroquinone derivative.

5. The electrostatic latent image developing toner according to claim 1, wherein a portion of each of the toner particles except the primary domains contains no antioxidant.

6. The electrostatic latent image developing toner according to claim 1, wherein the primary mixture contains an ester wax as the wax and at least one of an amine type antioxidant and a phenol type antioxidant as the antioxidant.

7. The electrostatic latent image developing toner according to claim 3, wherein the primary mixture contains an ester wax as the wax and the diphenylamine derivative as the antioxidant, the diphenylamine derivative being the amine type antioxidant.

8. The electrostatic latent image developing toner according to claim 4, wherein the primary mixture contains an ester wax as the wax and at least one of the cresol derivative and the hydroquinone derivative as the antioxidant, the cresol derivative and the hydroquinone derivative each being the phenol type antioxidant.

9. The electrostatic latent image developing toner according to claim 4, wherein the phenol type antioxidant is a hydroquinone derivative.

10. The electrostatic latent image developing toner according to claim 9, wherein the hydroquinone derivative is 2,5-di-tert-butylhydroquinone.

* * * * *